US007578370B1

(12) United States Patent
Morton

(10) Patent No.: US 7,578,370 B1
(45) Date of Patent: Aug. 25, 2009

(54) CORNER SUPPORT ASSEMBLY FOR WALL SCAFFOLDING

(76) Inventor: John Morton, 37 Mirimichi St., Plainville, MA (US) 02762

( * ) Notice: Subject to any disclaimer, the term of this patent is extended or adjusted under 35 U.S.C. 154(b) by 736 days.

(21) Appl. No.: 11/174,487

(22) Filed: Jul. 6, 2005

(51) Int. Cl.
*E04G 3/00* (2006.01)

(52) U.S. Cl. ..... 182/82

(58) Field of Classification Search ..... 182/82; 248/220.1, 240.3
See application file for complete search history.

(56) References Cited

U.S. PATENT DOCUMENTS

| | | | | | |
|---|---|---|---|---|---|
| 926,013 | A | | 6/1909 | Murdoch | |
| 968,836 | A | * | 8/1910 | Danforth | 248/240.3 |
| 1,595,643 | A | * | 8/1926 | Clark | 248/220.1 |
| 1,722,018 | A | * | 7/1929 | Sloan | 248/235 |
| 1,755,116 | A | * | 4/1930 | Henderson | 248/240.3 |
| 2,332,477 | A | | 10/1943 | Thornley | |
| D225,506 | S | * | 12/1972 | Priore | D8/72 |
| 4,122,916 | A | | 10/1978 | Strobel | |
| 6,865,859 | B2 | * | 3/2005 | Flathau | 52/742.14 |

FOREIGN PATENT DOCUMENTS

GB 2159203 A * 11/1985

* cited by examiner

*Primary Examiner*—Alvin C Chin-Shue
(74) *Attorney, Agent, or Firm*—John Brooks Law LLC; John J. Brooks, III

(57) ABSTRACT

A corner support assembly for attachment to wall scaffold bracket of wall scaffolding. The corner support assembly having an upper mounting adapter, a retaining adapter, a securing rod and a lower mounting adapter. The upper leg of the wall scaffold, the mounting adapter, the wall and the retaining adapter are sandwiched with the securing rod and a rod retaining nut, thereby securing the upper leg of the wall scaffold bracket in place against the wall. The lower mounting adapter and the lower leg of the wall scaffold bracket are forced against the wall providing additional support and stability for the wall scaffold bracket. The stabilizing flanges of the upper and the lower mounting adapters rest against the outside corner of the building and the scaffold bracket is stabilized around the corner. Workers are able to work safely around corners of buildings and they can quickly install the scaffold bracket using common wall scaffolding systems.

10 Claims, 4 Drawing Sheets

CORNER SUPPORT ASSEMBLY FOR WALL SCAFFOLDING

CROSS-REFERENCE TO RELATED APPLICATIONS

Not Applicable.

STATEMENT REGARDING FEDERALLY SPONSORED RESEARCH OR DEVELOPMENT:

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

1. Field of the Invention

This invention relates to wall scaffolding, specifically to methods of mounting and stabilizing scaffold brackets to walls.

2. Prior Art

Conventional scaffolding is used frequently in modern construction when workers must perform tasks above ground level. The scaffolding acts as a raised work platform from which workers work on structural features that cannot be easily reached while standing directly on the ground. Various types of scaffolding have been developed and used.

Scaffolding that extends from the ground, such as those that use pump-jacks or staging are frequently used. However, these systems are time consuming to set up which is not practical for residential construction. This scaffold type is also bulky and expensive because it structurally has to carry a significant amount of it's own weight.

Hanging scaffolding is also used. However, this is not a solution for all construction requirements because it requires free access to the top surface of a wall. This is not always possible.

Because of it's low cost, flexibility and ease of installation, wall scaffolding resembling the basic structure of U.S. Pat. No. 2,332,477 is very popular for construction workers working on the outside of buildings. This type of scaffolding structure can easily be transported, installed and moved by a single worker. Because of this, this type of wall scaffolding is one of the most popular types of scaffolding used on residential construction.

As construction methods and residential building designs have evolved, the prior art in this area has several shortcomings. One shortcoming is the incompatibility of modern scaffolding to work with prior art mounting systems. The most popular type of scaffolding includes a scaffold bracket to support planking and this bracket is secured to the wall with a through-hole mounting system. The scaffold bracket and mounting are quickly installed, quickly moved and safer than other mounting systems. U.S. Pat. No. 2,332,477 and U.S. Pat. No. 1,722,018 show several means to secure scaffolding to the walls, however, none of the mounting means are compatible with modern scaffolding systems. Through hole mounting systems are shown in U.S. Pat. No. 4,122,916 however, there are further improvements that provide more safety when used.

Another shortcoming of the prior art is shown when common wall scaffolding is used in modern applications. Modern construction frequently includes ornate framing designs that include corners and overhangs. Wall scaffolding systems are not readily available to support workers as they work around such designs. When working around corners, workers typically mount traditional wall scaffolding as close to the corner as possible, extend the planking beyond the wall bracket and work on the ends of the planking. Frequently, the planking is extended too far beyond the support of the scaffolding and when weight is put on the planking it will raise the opposite end of the planking off the scaffolding creating a very unstable and dangerous work environment. This is particularly true when scaffold planks must be suspended over a short span with corners on each end. A short span of planking provides less plank weight to counter the weight and resulting leverage of someone standing on an unsupported overhang of planking. This scenario of a short span including corners is common in many of today's home designs. U.S. Pat. No. 4,122,916 and U.S. Pat. No. 1,722,018 show scaffolding systems including mounts for mounting specific types of scaffolding on the corner of exterior walls. These types of scaffolding systems are difficult to set up and move. Additionally, the securing method disclosed is not as safe as and not specifically compatible with today's popular scaffolding systems.

OBJECTS AND ADVANTAGES

This invention addresses shortcomings in the current state of the art by providing an assembly that allows wall scaffolding to be securely mounted on the outside corners of structures such as homes and buildings. With multiple mounting adapters having a series of angled stabilizing flanges, the wall scaffold bracket is stabilized in the vertical plane around a corner. With this assembly attached to the wall scaffold bracket, workers can work around corners of buildings with the safety of a stable scaffold bracket directly underneath them.

Another feature of the present invention is the ability to use existing wall scaffold brackets with little or no modification. This allows traditional scaffold brackets to be used in corner applications with this assembly and when the assembly is removed, the same scaffold bracket can be used for flat wall surfaces. This provides for an economical solution to a common problem.

Another feature of the present invention is the ability to securely retain the wall scaffold bracket against the wall with a retaining plate and a securing rod. This through-hole means of securing the corner assembly to the wall is more secure than prior mounting adapters that disclose securing means such as nails.

Another feature of the present invention is the use of angled stabilizing flanges on the upper and lower mounting adapters to stabilize the wall scaffold bracket in the vertical plane around the corner of a wall.

Another feature of the present invention is the use of the retaining adapter with an angled securing plate that provides a safe means to anchor the wall scaffold bracket to the inside corner of a wall.

Another feature of the present invention is the inclusion of rigid support braces on the mounting adapters. With the symmetrical rigid support braces, the wall scaffold bracket is rigidly held in place with less possibility of the scaffold bracket swaying from side to side.

Another feature of the present invention is the introduction of protruding ears onto the rod retaining nut that is used to secure the securing rod in the assembly. The protruding ears allow the assembly to be quickly mounted and removed from the corners of a wall.

Another feature of the present invention is a design that can be manufactured easily and easily introduced into the market. The adapters of the assembly can be made from a single piece of rigid material such as rigid plastic, cast metal or similar materials. The assembly can also be made using common stock machine components such as plate steel.

BRIEF SUMMARY OF THE INVENTION

The current invention is a corner support assembly that attaches to the end of traditional wall scaffolding and enables it to be securely mounted on an outside corner of a building. The assembly includes an upper mounting adapter, a retaining adapter, a securing rod and a lower mounting adapter. The upper mounting adapter includes a mounting plate with support braces, stabilization flanges and a centrally located through-hole. The retaining adapter includes a retaining plate, a securing plate and a centrally located through-hole. The securing rod is received though the scaffold bracket and the through-holes in the upper mounting and retaining adapter and a hole in the wall. By sandwiching the upper leg of the wall scaffold bracket, the mounting adapter, the wall and the retaining adapter with the securing rod and a rod retaining nut, the upper leg of the wall scaffold bracket is securely retained in place against the wall. The lower mounting adapter is similar to the upper mounting adapter having a mounting plate with support braces and stabilization flanges. The lower mounting adapter further includes a securing nub to secure the lower mounting adapter to the lower leg of the wall scaffold bracket. With the upper leg of the wall scaffold bracket sandwiched against the wall, the lower mounting adapter and the lower leg of the wall bracket are forced against the wall providing additional support and stability for the wall scaffold bracket.

When the assembly is installed, the rigid flanges of the upper and the lower mounting adapters rest against the outside corner of the building and the scaffold bracket is stabilized on the corner. With the scaffold bracket mounted in this manner, workers are able to work around corners of buildings with the safety of a stabilized scaffold bracket directly underneath them. Workers are also able to quickly mount and move the scaffolding using common wall scaffolding brackets.

BRIEF DESCRIPTION OF THE SEVERAL VIEWS OF THE DRAWING

The features, advantage and operation of the present invention will become readily apparent and further understood from a reading of the following detailed description with the accompanying drawings, in which like numerals refer to like elements, and in which.

DETAILED DESCRIPTION OF THE INVENTION

Figure 1:
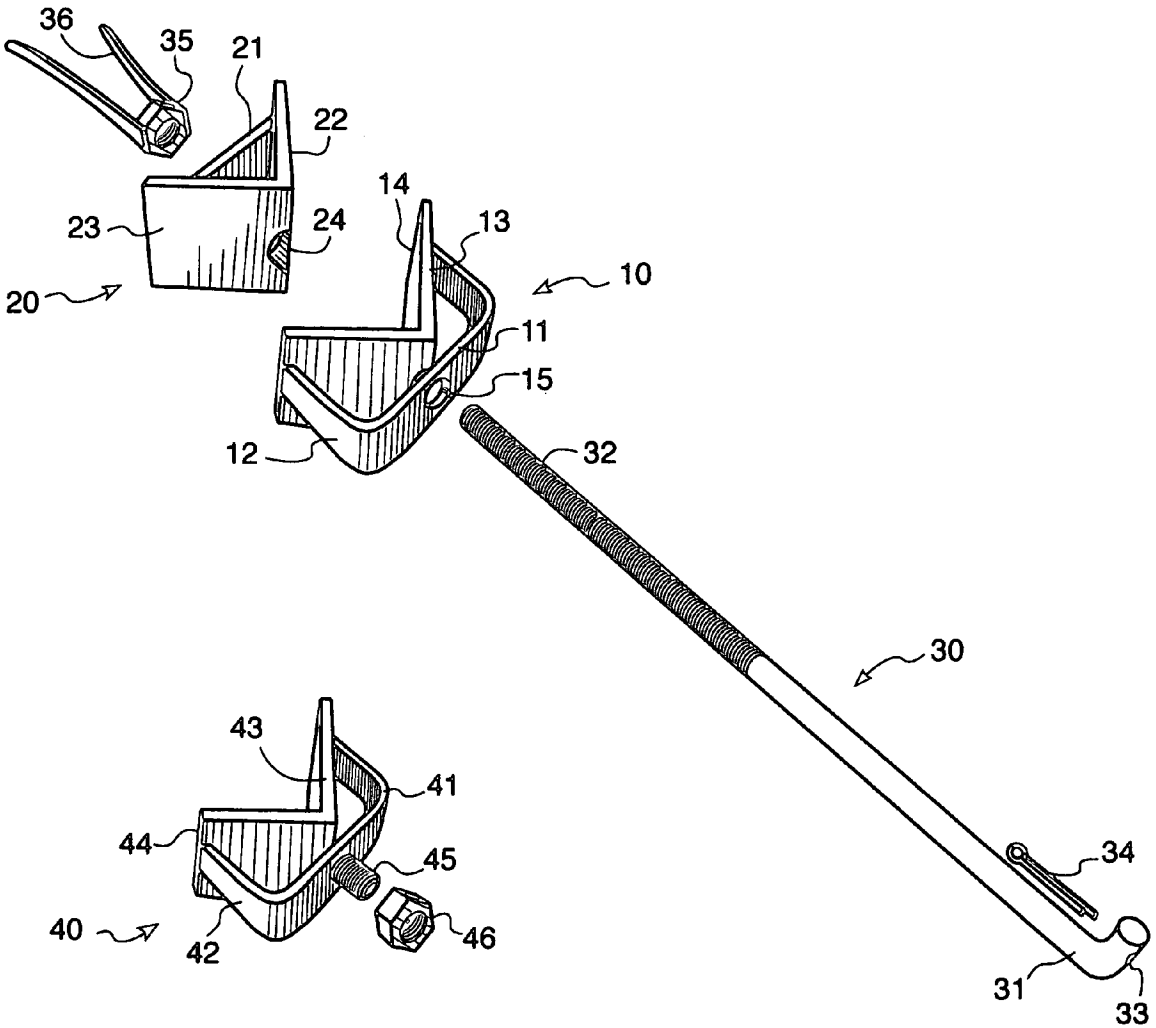
FIG. 1 is a top side perspective view of the exploded assembly.

One form of the invention is illustrated and described herein. In general, the corner support assembly comprises an upper mounting adapter as indicated in the figures by the numeral 10, a retaining adapter as indicated by the numeral 20, a securing rod as indicated by the numeral 30 and a lower mounting adapter as indicated by the numeral 40. The invention interoperates with a wall scaffold bracket indicated in the figures by the numeral 60.

Figure 4:
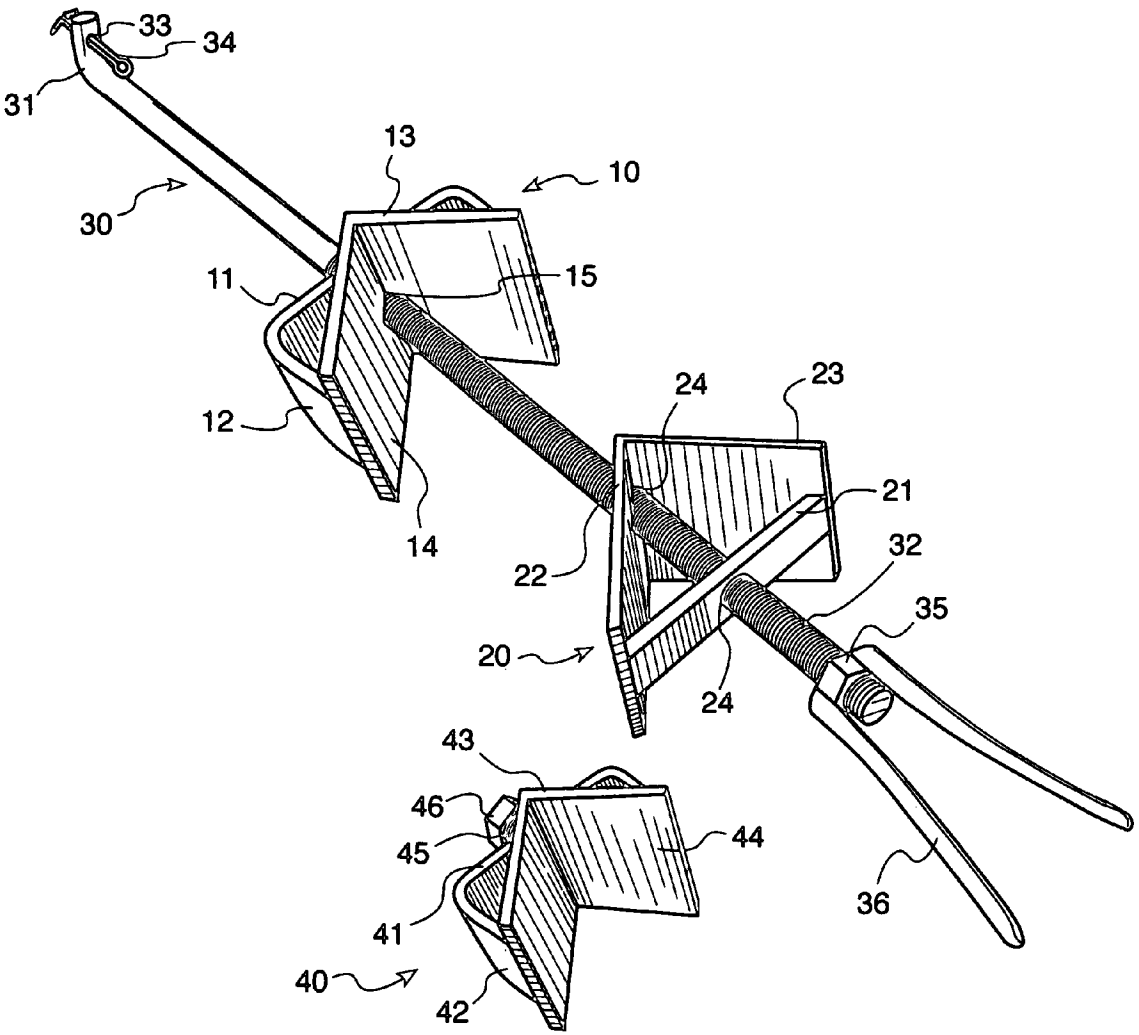
FIG. 4 is a top side perspective view of the assembly assembled and viewed from the opposite side of that shown in FIG. 1.

A preferred embodiment of the invention is shown in FIG. 1. The upper mounting adapter 10 consists of a stabilization plate 13, a mounting plate 11 and a centrally located through-hole 15. The mounting plate 11 is typically made from plate steel and angled on both ends at 90° angles to create symmetrical support braces 12. The back face of the mounting plate 11 is generally flat. The stabilization plate is typically made from plate steel and centrally angled to create a pair of symmetrical stabilizing flanges 14. When rigidly attached by means such as welding, the upper mounting adapter 10 is a single adapter designed to vertically stabilize wall scaffolding around an outside wall corner. In it's preferred embodiment, the angle of the bend at the center of the stabilization plate 13 is 90° allowing it to rest flush on the outside of a 90° wall corner. FIG. 1 and FIG. 4 show the upper mounting adapter 10 including a centrally located mounting through-hole 15 through the stabilization plate 13 and the mounting plate 11.

The retaining adapter 20 shown in FIG. 1 is adapted to provide an anchor to retain the upper mounting adapter 10 against the wall. The retaining adapter 20 consists of a retaining plate 21 and a securing plate 22. The retaining plate 21 is flat and made of a rigid material such as plate steel. The securing plate 22 is also made of a rigid material such as plate steel and is symmetrically angled about it's center to create securing flanges 23. The securing flanges 23 are angled towards the retaining plate 21 so that the securing flanges 23 will rest securely against the inside corner of a wall's structural members. When the retaining plate 21 and the securing plate 22 are rigidly attached by such means as welding, the retaining adapter 20 is a single adapter. FIG. 1 and FIG. 4 show the retaining adapter 20 including a centrally located retaining through-hole 24, through both the retaining plate 21 and the securing plate 22.

As shown in FIG. 1, the securing rod 30 is an elongated rod with a threaded end 32 and an opposing end 31. The threaded end 32 is received in the mounting through-hole 15 in the upper mounting adapter 10 and the retaining through-hole 24 in the retaining adapter 20. The opposing end 31 is bent 90° at it's end and includes a radial retaining pin hole 33 to hold a retaining pin 34.

As shown in FIG. 1, the lower mounting adapter 40 is similar to the upper mounting adapter 10. The lower mounting adapter 40 consists of a stabilization plate 43 and a mounting plate 41. The mounting plate 41 is typically made from plate steel and angled on both ends at 90° angles to create symmetrical support braces 42. The back face of the mounting plate 41 is generally flat. The stabilization plate 43 is typically made from plate steel and centrally angled to create a pair of symmetrical stabilizing flanges 44. When rigidly attached by means such as welding, the lower mounting adapter 40 is a single adapter designed to vertically stabilize wall scaffolding around an outside wall corner. Generally, the angle of the bend at the center of the stabilization plate 43 is 90° to allow it to rest flush on the outside of a 90° wall corner. The lower mounting adapter 40 also includes a securing nub 45 secured to the back of the mounting plate 41 and a nub retaining nut 46. There are many embodiments that can be used for the securing nub 45, the preferred embodiment described here uses a threaded rod welded onto the back side of the mounting plate 41. This nub is of sufficient length to go through the lower mounting hole 65 of the lower leg 64 of the wall scaffold bracket and to receive a threaded nub retaining nut 46.

There are alternative embodiments of the invention. To accommodate different corner angles of walls, the angle of the stabilizing flanges 14 relative to each other and the angle of the securing flanges 23 relative to each other can be varied to ensure the stabilizing flanges 14 and the securing flanges 23 are kept flush with the wall surface. Similarly, for the lower mounting adapter 40, the angle of the stabilizing flanges 44 about the center of the stabilization plate 43 can be varied.

It is also possible to have the dimensions of the securing flanges 23 of the retaining adapter 20, the stabilizing flanges 14 of the upper mounting adapter 10 and the stabilizing flanges 44 of the lower mounting adapter 40 longer to provide additional stabilization for the wall scaffold bracket.

It is also possible to have each of the mounting adapters and the retaining adapter integrally formed from single pieces of material.

It is also possible for the adapters and securing rod to be made from other rigid materials such as cast metals and rigid plastics.

It is also possible to have different embodiments of the securing nub 45 such as pressure clips or hooks sufficient to retain the lower mounting adapter 40 in the lower mounting hole 65 of the wall scaffold bracket 60.

Operation:

FIG. 4 shows the interoperation of the assembly elements in a perspective view. The securing rod 30 is received through the through-holes 24 and 15 in the retaining adapter 20 and the upper mounting adapter 10 respectively. The threaded end 32 of the securing rod 30 receives the rod retaining nut 35. The rod retaining nut 35 is threaded to be received by the threaded end of the securing rod 30. The rod retaining nut 35 also includes rigid protruding ears 36 that can be used to tighten and loosen the securing nut onto the securing rod 30. The opposing end 31 of the securing rod 30 is angled 90° and includes a retaining pin hole 33 that receives a retaining pin 34. The stabilization plate 13 of the upper mounting adapter 10 and the securing plate 22 of the retaining adapter 20 oppose each other in operation so that the assembly will rest in and around the support members 51 of the wall 50 as shown in FIG. 3.

Figure 2:
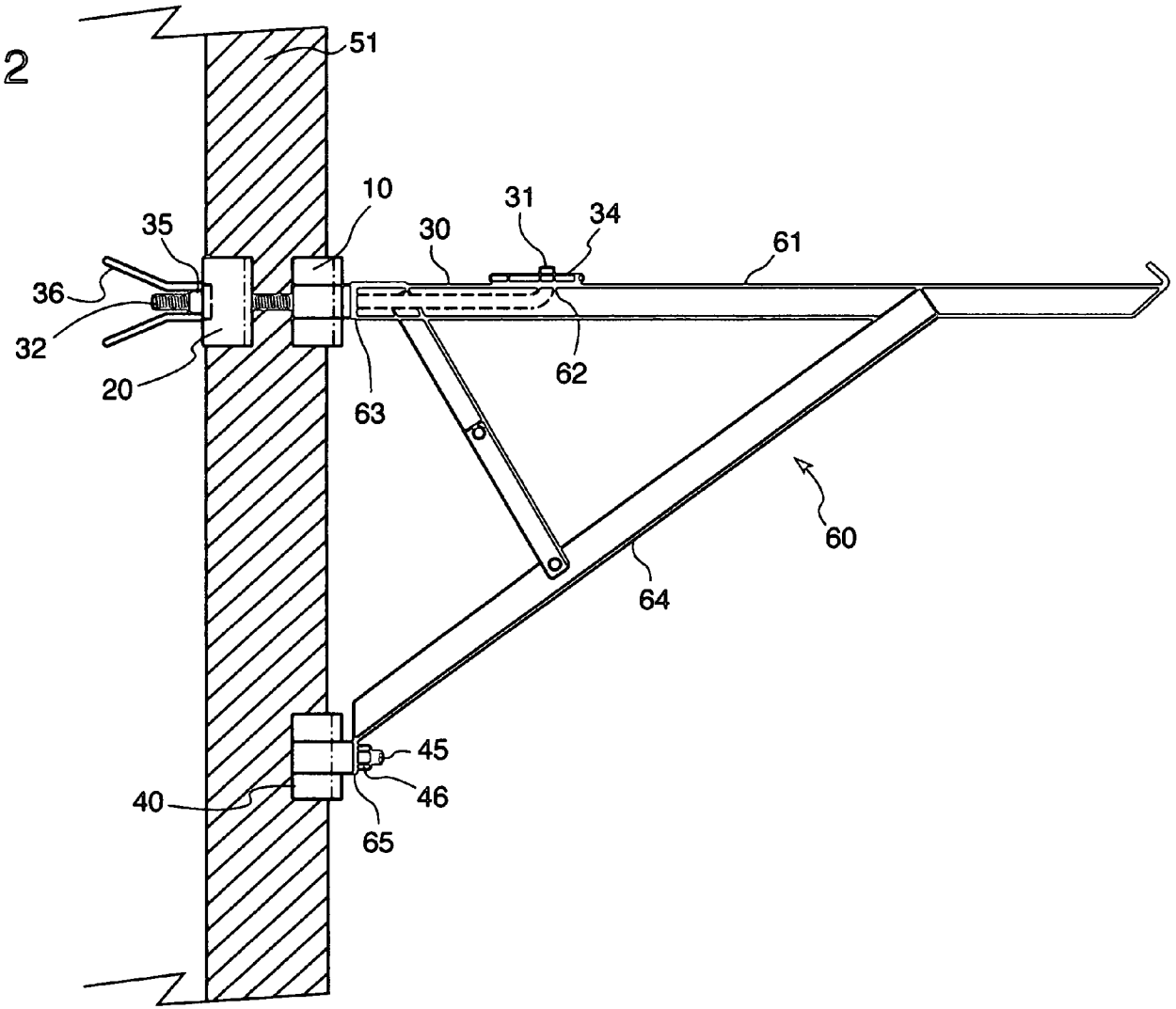
FIG. 2 is a side view of the assembly mounted on the corner of a wall.

FIG. 2 shows a side view of the assembly attached to the wall scaffold bracket 60 and mounted on the support members 51. The upper mounting adapter 10 attaches to the upper leg 61 of the wall scaffold bracket 60 by using the threaded securing rod 30 secured through the upper mounting hole 63 and the securing rod hole 62 of the wall scaffold bracket 60. The securing rod 30 is held in the securing rod hole 62 by a removable retaining pin 34. The retaining pin 34 is inserted into the retaining pin hole 33 after the opposing end 31 is inserted into the upper mounting hole 63 and the securing rod hole 62 of the upper leg 61 of the wall scaffold bracket 60. The threaded end 32 of the securing rod 30 is received through several elements to include the upper mounting adapter 10, the wall 50, and the retaining adapter 20. The securing rod 30 is secured by the use of the rod retaining nut 35. The rod retaining nut 35 is tightened onto the securing rod 30 by twisting the protruding ears 36. FIG. 4 shows the operation of the securing rod 30 through the upper mounting adapter through-hole 15 and the retaining adapter through-hole 24 and into the rod retaining nut 35.

Also shown in FIG. 2, the lower mounting adapter 40 is secured to the lower leg 64 of the wall scaffold bracket 60 by inserting the securing nub 45 into the lower mounting hole 65 and securing it in place with a nub retaining nut 46. The lower mounting hole 65 must be of sufficient size to accept the securing nub 45.

Figure 3:
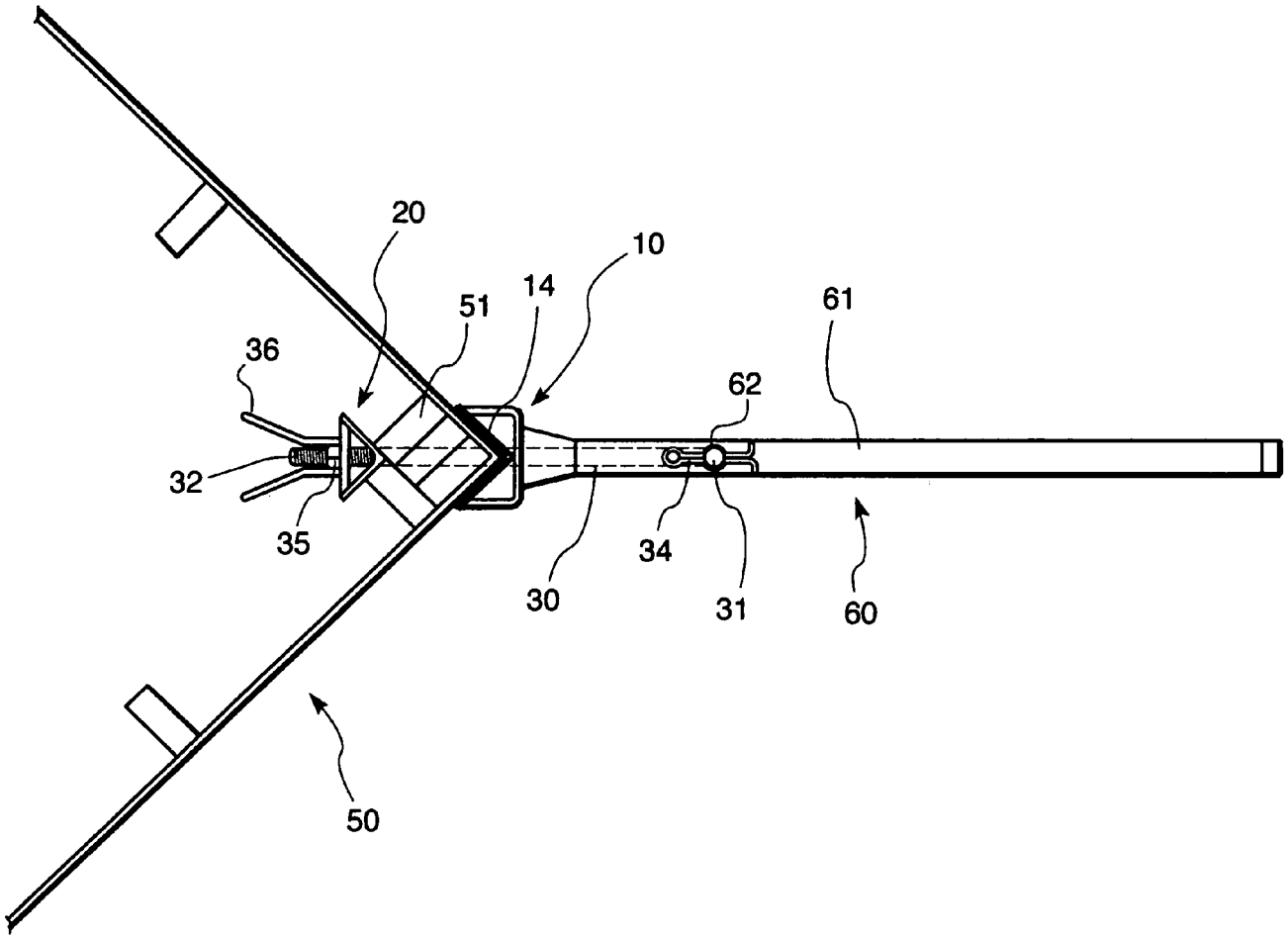
FIG. 3 is a top plan view of the assembly mounted on the corner of a wall.

As shown in FIG. 3 from a top view of an installed corner support assembly, the result of the operation of the assembly is the securing rod 30 and the rod retaining nut 35 sandwiching the wall scaffold bracket 60, the upper mounting adapter 10, the vertical wall support members 51 and the retaining adapter 20 whereby the wall scaffold bracket 60 is rigidly held against the wall 50 and stabilized. The securing rod 30 stabilizes the scaffold bracket against the wall 50 and prevents the scaffold bracket 60 from moving in the horizontal plane. The stabilizing flanges 14 of the upper mounting adapter 10 and the stabilizing flanges 44 of the lower mounting adapter 40 stabilize the scaffold bracket in the vertical plane.

The result of the operation of this assembly allows a common wall scaffold bracket 60 to be used to let workers work around corners of buildings with the safety of a stable scaffold bracket 60 directly underneath them.

Another feature of this invention is the use of through-hole mounting that provides a secure mount for the wall scaffold bracket 60. The design permits the securing rod 30 to be received through the upper mounting adapter through-hole 15 in the upper mounting adapter 10, the wall 50 and the retaining adapter retaining through-hole 24 in the retaining adapter 20 with all of these elements being secured in place with the rod retaining nut 35.

Another feature of this invention is the interoperability of the assembly with common wall scaffold bracket 60. The securing rod 30 design and through-hole mounting design that interoperates with the upper mounting hole 63 and the securing rod hole 62 already present in common wall scaffold brackets. The lower mounting adapter 40 design interoperates with the lower mounting hole 65 of the lower leg 64 of the wall scaffold bracket 60.

Another feature of this invention is the use of angled stabilizing flanges 14 on the upper mounting adapter 10 and angled stabilizing flanges 44 on the lower mounting adapter 40 that stabilize the wall scaffold bracket 60 in the vertical plane around the corner of a wall 50.

Another feature of this invention is the use of the retaining adapter 20. The combination of the through-hole mounting of the adapter 20, the shape of the securing plate 22 and the use of the rod retaining nut 35 with rigid protruding ears 36 provides a safe and secure mounting against the inside support members 51 of a wall 50.

Another feature of this invention is the use of the support braces 12 in the upper mounting adapter 10 and the support braces 42 in the lower mounting adapter 40. The support braces 12 and 42 ensure that the stabilizing flanges 14 and 44 respectively are kept rigid.

Another feature of the present invention is the introduction of protruding ears 36 onto the rod retaining nut 35 that allows the assembly to be quickly installed and uninstalled onto the corner of a wall 50.

Another feature of the present invention is the design that can be manufactured easily. The upper mounting adapter 10, the lower mounting adapter 40 and the retaining adapter 20 of the assembly can be made from a single piece of rigid material such as rigid plastic, cast metal or similar materials. The stabilization plate 13, the mounting plate 11, the retaining plate 21, the securing plate 22 and the securing rod 30 can also be made from common stock metal components.

Although the description above contains many specificities, these should not be construed as limiting the scope of the invention but as merely providing illustration of some of the presently preferred embodiments of this invention. The present invention may be embodied in other specific forms without departing from the spirit or essential attributes thereof and, accordingly, the scope of the invention should be made to the appended claims, rather than the foregoing specification.

What is claimed is:

1. The corner support assembly for securing a lower leg and an upper leg of wall scaffold bracket to structural members of a wall, the corner support assembly comprising:

an upper mounting adapter having a mounting plate and a stabilization plate;

a retaining adapter having a retaining plate;

a lower mounting adapter having a mounting plate and a stabilization plate;

said mounting plate for said upper and lower mounting adapter having a front face and a back face with said front face is supportively fixed to said stabilization plate and said back face is shaped to be flush against the wall scaffold bracket;

said stabilization plate for said upper and lower mounting adapters having a center and a plurality of symmetrically diverging rigid stabilizing flanges extending from said center;

said mounting plate further comprises a plurality of symmetrically angled support braces contacting said stabilizing flanges maintaining rigidity of said stabilizing flanges;

said retaining plate and said upper mounting adapter having a means for sandwiching upper leg of said wall scaffold bracket, said upper mounting adapter, said wall and said retaining adapter;

said back face of said lower mounting adapter having a means for attaching said lower mounting adapter to said lower leg of wall scaffold bracket; and said sandwiching means securely retains said upper mounting adapter and the upper leg of the wall scaffold bracket against the wall and said attaching means connects said lower mounting adapter to the lower leg of the wall scaffold bracket whereby said lower mounting adapter stabilizing flanges are urged against the wall and the wall scaffold bracket is stabilized against said wall.

2. The corner support assembly of claim 1 wherein said sandwiching means includes a securing rod with an opposing end angled and retained in the upper leg of the wall scaffold bracket and a threaded end received through a centrally disposed through-hole in said upper mounting adapter, a through-hole in the wall and a centrally disposed through-hole in said retaining plate and retained by a threaded rod retaining nut.

3. The corner support assembly of claim 1 wherein said attaching means for said lower mounting adapter includes a protruding threaded nub fixed to said lower mounting adapter mounting plate and retained through a hole in the lower leg of the wall by a threaded nub retaining nut.

4. The corner support assembly of claim 1 wherein said stabilizing flanges with a generally vertical surface allowing said vertical surfaces of said flanges to rest on the wall.

5. The corner support assembly of claim 1 wherein said retaining adapter further comprises a securing plate having a centrally angled shape with an apex opposed to said retaining plate.

6. The corner support assembly of claim 1 wherein said mounting plate and said stabilization plate of said upper and lower mounting adapters are integrally formed from a single piece of material.

7. A corner support assembly for securing a lower leg and an upper leg of a wall scaffold bracket to structural members of a wall, the corner support assembly comprising:

an upper mounting adapter having a mounting plate a stabilization plate, a center and a centrally disposed through-hole;

a retaining adapter having a retaining plate, a securing plate and a centrally disposed through-hole;

a lower mounting adapter having a mounting plate, a stabilization plate and a center;

a securing rod having a threaded end and an opposing end;

a threaded rod retaining nut;

a threaded nub retaining nut;

said mounting plate for said upper and lower mounting adapter having a front face and a back face where said front face is supportively fixed to said stabilization plate and said back face is shaped to be flush against the wall scaffold bracket;

said stabilization plate for said upper and lower mounting adapter having a plurality of symmetrically diverging rigid stabilizing flanges extending from said center of said stabilization plate;

said stabilizing flanges having a generally vertical surface allowing said vertical surfaces of said flanges to rest on the wall;

said mounting plate further comprises a plurality of symmetrically angled support braces contacting said stabilizing flanges transferring force from and maintaining rigidity of said stabilizing flanges;

said securing plate of said retaining adapter having a centrally angled shape with an apex opposed to said retaining plate;

said back face of said mounting plate of said lower mounting adapter having a threaded securing nub secured through said lower leg of the wall scaffold bracket by said threaded nub securing nut;

said opposing end of said securing rod angled and removeably secured to the upper leg of the wall scaffold bracket and said threaded end of said securing rod received in said retaining adapter through-hole and in received in said upper mounting adapter through-hole sandwiching the upper leg of the wall scaffold bracket, said upper mounting adapter, the wall and said retaining adapter with said threaded rod retaining nut; and said sandwiching of said upper mounting adapter against the wall urges said stabilizing flanges of said upper and lower mounting adapters against the wall whereby the wall scaffold bracket is stabilized on the wall.

8. The corner support assembly of claim 7 wherein said rod retaining nut further comprises a plurality of protruding ears whereby said rod retaining nut can easily be accessed when said corner support assembly is installed on the corner of the wall.

9. The corner support assembly of claim 7 wherein said mounting plate and said stabilization plate of said mounting adapter are integrally formed from a single piece of material.

10. The corner support assembly of claim 7 wherein said retaining plate is shaped to span the width of the vertical structure members of the wall.

* * * * *